US008187025B2

(12) United States Patent
Luzzi

(10) Patent No.: US 8,187,025 B2
(45) Date of Patent: May 29, 2012

(54) SPLICE RESTRAINT AND MATING INDICATOR

(75) Inventor: Glenn J. Luzzi, Mt. Bethel, PA (US)

(73) Assignee: Richards Manufacturing Company, a New Jersey Limited Partnership, Irvington, NJ (US)

( * ) Notice: Subject to any disclaimer, the term of this patent is extended or adjusted under 35 U.S.C. 154(b) by 0 days.

(21) Appl. No.: 13/219,115

(22) Filed: Aug. 26, 2011

(65) Prior Publication Data

US 2011/0315422 A1 Dec. 29, 2011

Related U.S. Application Data

(63) Continuation of application No. 12/568,158, filed on Sep. 28, 2009, now Pat. No. 8,070,509.

(60) Provisional application No. 61/243,018, filed on Sep. 16, 2009.

(51) Int. Cl.
*H01R 3/00* (2006.01)

(52) U.S. Cl. ..... 439/489; 439/369; 439/798

(58) Field of Classification Search ..... 439/489, 439/367, 368, 369, 798, 799, 183; 174/21 R
See application file for complete search history.

(56) References Cited

U.S. PATENT DOCUMENTS

| | | | | |
|---|---|---|---|---|
| 3,295,548 | A | | 1/1967 | Woods |
| 3,516,300 | A | | 6/1970 | Mickinhaupt |
| 3,609,646 | A | | 9/1971 | Becker et al. |
| 3,881,753 | A | | 5/1975 | Bochory |
| 4,641,646 | A | | 2/1987 | Schultz et al. |
| 4,799,895 | A | | 1/1989 | Borgstrom |
| 4,891,016 | A | | 1/1990 | Luzzi et al. |
| 5,328,384 | A | * | 7/1994 | Magnuson ..... 439/369 |
| 5,427,538 | A | | 6/1995 | Knapp et al. |
| 5,507,533 | A | * | 4/1996 | Mumma ..... 285/114 |
| 5,683,273 | A | | 11/1997 | Garver et al. |
| 5,857,862 | A | | 1/1999 | Muench et al. |
| 5,873,608 | A | | 2/1999 | Tharp et al. |
| 5,876,234 | A | * | 3/1999 | Hester ..... 439/369 |
| 6,062,917 | A | | 5/2000 | Kingston |
| 6,065,782 | A | | 5/2000 | Allen, Jr. |
| 6,139,068 | A | * | 10/2000 | Burress et al. ..... 285/92 |
| 6,364,721 | B2 | | 4/2002 | Stewart, III |
| 7,278,889 | B2 | | 10/2007 | Muench et al. |
| 7,384,287 | B2 | | 6/2008 | Hughes et al. |
| 7,407,405 | B1 | * | 8/2008 | Slenczka ..... 439/369 |
| 7,413,455 | B2 | | 8/2008 | Hughes et al. |
| 2003/0157826 | A1 | | 8/2003 | Moreno et al. |

* cited by examiner

OTHER PUBLICATIONS

Cooper Power Systems (Waukesha, WI), "200 A 15 kV Class Insulated Protective Cap" product description, Electrical Apparatus 500-21, published Apr. 1996.

*Primary Examiner* — Hae Moon Hyeon
(74) *Attorney, Agent, or Firm* — Stroock & Stroock & Lavan LLP

(57) ABSTRACT

The present invention relates to a splice restraint for use with sleeves that attach to joints. The splice restraint includes a first securing member constructed and arranged to be received in a groove of a first sleeve that is installable on a first leg of a joint, a second securing member constructed and arranged to be received in a groove of a second sleeve that is installable on a second leg of the joint, and a strap connecting the first securing member to the second securing member. The strap having a length determined by the distance between the groove on the first sleeve and the groove on the second sleeve when the first and second sleeves are properly installed on the joint. The splice restraint provides a visual indication that the sleeves are properly installed on the joint, as well ensures that sleeves will not be displaced after the lineman leaves the site.

11 Claims, 12 Drawing Sheets

SPLICE RESTRAINT AND MATING INDICATOR

CLAIM OF PRIORITY

This application is a continuation of U.S. patent application Ser. No. 12/568,158, filed on Sep. 28, 2009 now U.S. Pat. No. 8,070,509, which claims the benefit of priority under 35 U.S.C. §119(e) to U.S. Provisional Application No. 61/243,018, filed Sep. 16, 2009. The contents of both of these applications are included herein by reference.

BACKGROUND OF THE INVENTION

In a typical electrical power distribution system, there exist various devices to connect power distribution cables together. For example, disconnectable joints such as I or U, Y and H connectors are typically used to electrically connect two, three or four individual cables, respectively. These connections often include an insulating housing and an appropriate number of sleeves. For example, an I connector can electrically connect two cables, and a sleeve can be placed over each connection. The sleeves are often positioned over the connection point, with or without a tool, to insulate, cover and protect the electrical connection.

An example of a drawback of commonly used disconnectable joint systems for connecting cables includes the sleeve coming off inadvertently, which can create a dangerous situation for the lineman and/or the public or result in power outages. When air gets trapped inside the sleeve, or if the sleeve is not properly installed, or if a cable has water in the strands, are examples of situations which may cause the sleeve to come off and expose energized portions of the joint.

In light of the shortcomings of the conventional methods and applications known in the art, it is desirable to provide a device that helps ensure proper installation of the sleeve(s) onto a joint and help prevent inadvertent removal or loosening thereof.

BRIEF SUMMARY OF THE INVENTION

The present invention relates to novel splice restraints for use with sleeves and joints. The present invention is a simple, economical device that helps maintain the sleeve(s) on the joint while at the same time providing a visual indication that sleeves are properly installed.

In one aspect of the present invention, the splice restraint includes a first securing member constructed and arranged to engage a first sleeve installable on a first leg of a joint, a second securing member constructed and arranged engage a second sleeve installable on a second leg of said joint, and one or more straps connecting the first securing member to the second securing member, the strap(s) having a length determined by the distance between the mating point on the first sleeve and the mating point on the second sleeve when the first and second sleeves are properly installed on the joint. The mating point on the first and second sleeves may be, by way of example, within or on one side of a groove on the sleeve, at an end of the sleeve proximate the cable entrance, or any other point on the sleeve to which the securing member can be securely fastened. In addition, the mating point on one sleeve may be the same as the mating point on a second sleeve, or the mating points on the two sleeves could be different.

In another aspect of the present invention, the splice restraint includes a securing member constructed and arranged to engage a sleeve installable on a first leg of a joint, a plate member constructed and arranged to cover a second leg of said joint, and one or more straps connecting the securing member to the plate member, the strap(s) having a length determined by the distance between the mating point on the sleeve and the end of the second leg when the sleeve is properly installed on the joint. The mating point on the sleeve may be, by way of example, within or on one side of a groove on the sleeve, at an end of the sleeve proximate the cable entrance, or any other point on the sleeve to which the securing member can be securely fastened.

In another aspect of the present invention, the splice restraint includes a first securing member constructed and arranged to engage a first sleeve installable on a first leg of a joint, a second securing member constructed and arranged to engage a second sleeve installable on a second leg of said joint, a plate member constructed and arranged to cover a third and fourth leg of the joint, one or more first strap(s) connecting the first securing member to the plate member, one or more second straps connecting the second securing member to the plate member, the first strap(s) having a length determined by the distance between the mating point on the first sleeve and the end of the third leg when the sleeve is properly installed on the joint, and the second strap(s) having a length determined by the distance between the mating point on the second sleeve and the end of the fourth leg when the sleeve is properly installed on the joint. The mating point on the first and second sleeves may be, by way of example, within or on one side of a groove on the sleeve, at an end of the sleeve proximate the cable entrance, or any other point on the sleeve to which the securing member can be securely fastened. In addition, the mating point on one sleeve may be the same as the mating point on a second sleeve, or the mating points on the two sleeves could be different.

In another aspect of the present invention, the splice restraint can be incorporated into a tool for positioning a sleeve onto a joint, wherein the splice restraint includes a first securing member constructed and arranged to engage the joint, a second securing member constructed and arranged engage a sleeve installable on the joint, and one or more flexible straps connected to the first securing member and movably engaging the second securing member, the strap(s) having a handle mechanism, wherein a user can pull on the handles of the straps in order to position the sleeve on the joint, and wherein the strap(s) and/or first securing member include a locking mechanism that engages when the sleeve is properly positioned on the joint.

These and other aspects, features, steps and advantages can be further appreciated from the accompanying figures and descriptions of certain illustrative embodiments.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DESCRIPTION OF A PREFERRED EMBODIMENT OF THE INVENTION

By way of background, and as one of ordinary skill in the art would understand, an I joint has two legs for connecting two cables. Preferably, the I joint includes a conductive projection on each leg that is connected to a conductive lug of a cable assembly to maintain the flow of electricity between the cable assembly and the joint. Once the cables are installed on the I joint, sleeves can be positioned over each connection. Similarly, a Y joint includes three legs for connecting three cables, and H joint includes four legs for connecting four cables, and a U joint includes two legs for connecting two cables.

Figure 1:
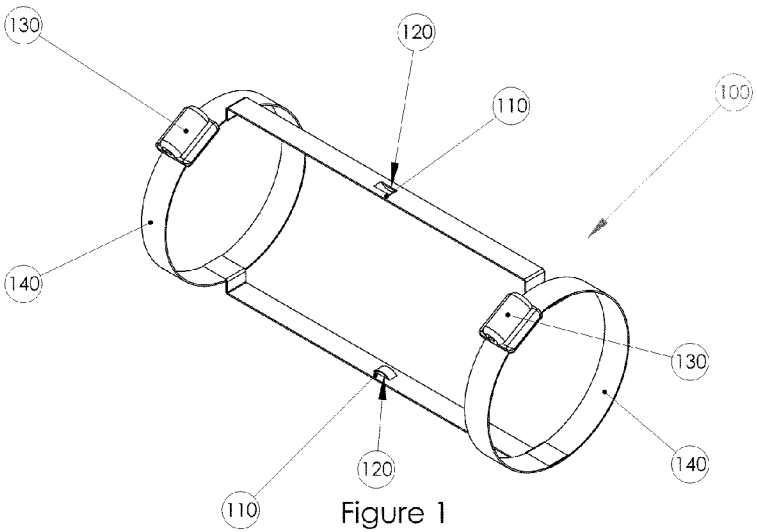
FIG. 1 is a perspective view of a splice restraint system in accordance with an embodiment of the invention.
Figure 2:
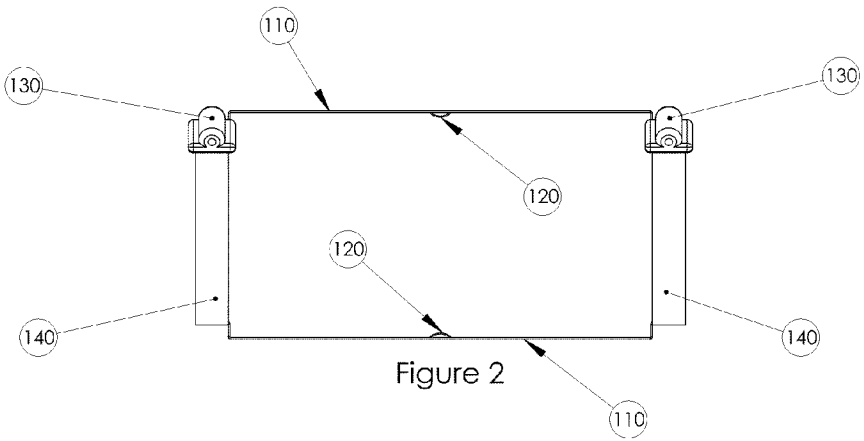
FIG. 2 is a side view of the splice restraint system of FIG. 1.
Figures 3, 3A:
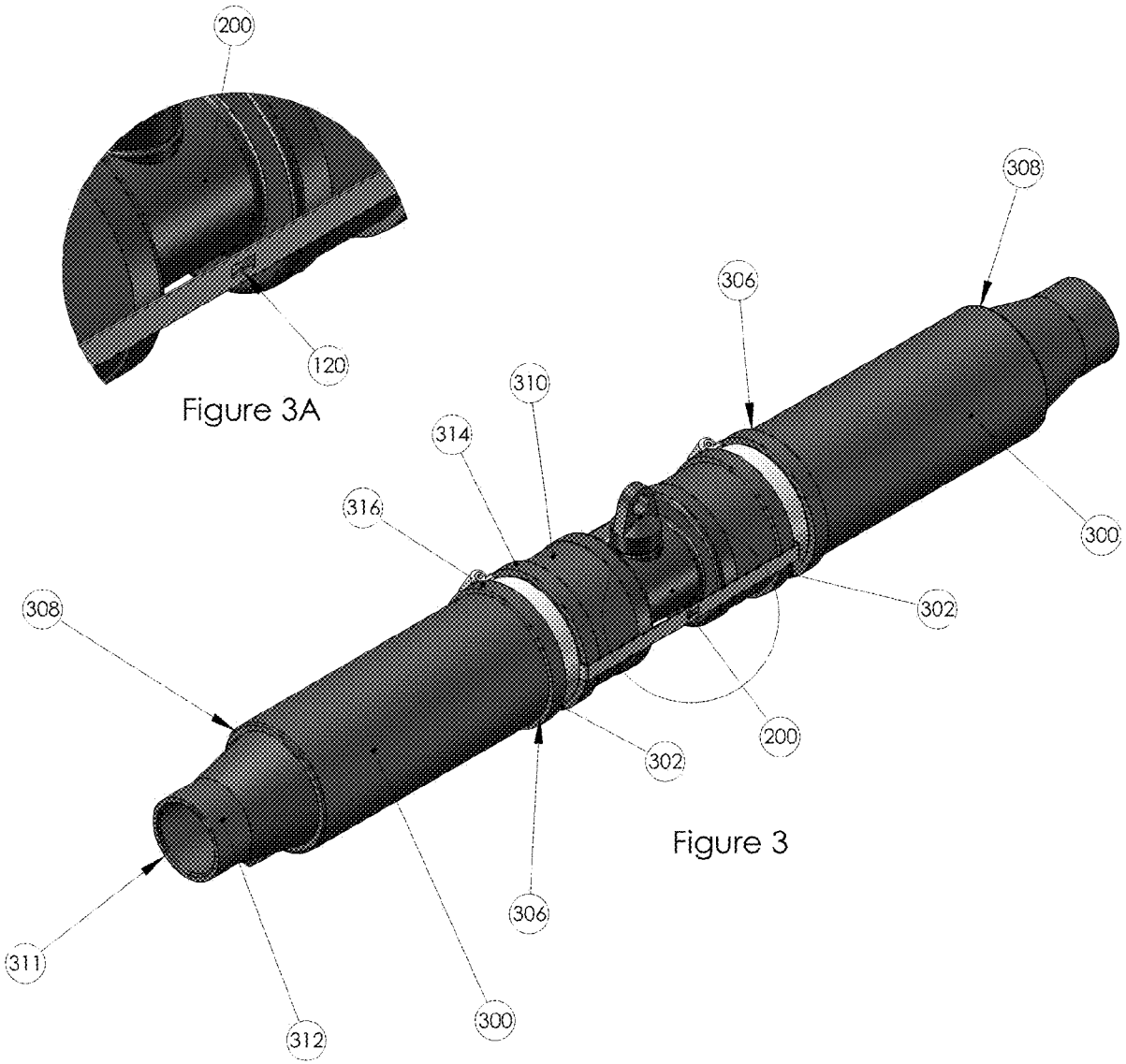
FIG. 3 is a perspective view of the splice restraint system of FIG. 1 installed on an I joint with a sleeve on each leg of the I joint.
FIG. 3A is an enlarged view of the grounding eye element of the splice restraint system of FIG. 3.

In accordance with an embodiment of the present invention as shown in FIGS. 1-4, splice restraint 100 is constructed and arranged to secure sleeve 300 to a second sleeve 300 positioned on the opposite end of joint 200. As seen in FIG. 3, a conventional sleeve typically includes one end 310 that has an opening to engage joint 200, and a second end 312 that has an opening 311 to accept a cable. Sleeve 300 also typically includes an end 308 that transitions down to accept the cable. The sleeve 300 also typically includes raised members 314 and 316 that form a groove 302. Groove 302 is typically used with a tool (not shown) to assist in positioning sleeve 300 over joint 200.

More specifically, as seen in FIGS. 1-4, sleeve 300 preferably includes a groove or channel 302 proximate the end of sleeve 300 that is installed over the joint 200. Groove 302 is typically used to position an interface clamp which can increase the dielectric performance of the 310 to 200 interface. Preferably, sleeve 300 includes a raised member 314 between groove 302 and the opening of sleeve 300 that is intended to be installed on joint 200. More preferably, raised member 314 (and raised member 316) has an outer diameter greater than the outer diameter of groove 302. A tool can be used to position sleeve 300 over the connection with the joint 200 by gripping sleeve 300 at groove 302. After sleeve 300 and second sleeve 300 are properly installed and in position, splice restraint 100 can be provided to help secure sleeves 300 in place over joint 200.

FIGS. 1 and 2 illustrate an embodiment of splice restraint 100 prior to being installed on sleeves 300 and joint 200. As shown, splice restraint 100 can include one or more straps 110 connected to one or more securing members 140. Securing member 140 is preferably designed and constructed as the interface clamps that are used to increase the dielectric performance of the 310 to 200 interface. Preferably, splice restraint 100 includes two straps 110 connected to two securing members 140, as seen in FIG. 1. Straps 110 preferably have a length determined by the distance grooves 302 of sleeves 300 when properly installed over joint 200. Straps 110 also preferably include a grounding eye 120 as seen in FIGS. 1-4. The grounding eye 120 offers a preferred place for drain wire grounding of the overall joint, which can help alleviate grounding issues with prior art joints which typically encounter breakage of the rubber grounding tabs used in the prior art.

Securing members 140 are preferably of a shape that corresponds to the shape of the groove 302 of sleeve 300. In a preferred embodiment, securing member 140 is circular as seen in FIG. 1. Securing member 140 also preferably includes a tightening device 130 for securing the securing member 140 within the groove 302 of the sleeve 300. In a preferred embodiment, the tightening device is a worm gear-type tightening device. Securing members 140 can be a closed-loop member, as seen in FIG. 1, wherein the securing member is large enough to slide over sleeve 300 and be tightened within groove 302 via tightening device 130, or securing member 140 may be an open-loop design wherein the securing member 140 can be placed into groove 302 after the sleeve is placed on joint 200 and the loop subsequently closed and tightened by placing the open end of securing member 140 through the tightening device 130 to close the loop. Alternatively, securing member 140 may be a resilient open design that is flexible enough to expand when sufficient pressure is applied to deform into groove 302, and resilient enough to provide the strength to hold sleeves 300 onto joint 200 without requiring a tightening device 130. In any application, when installed, splice restraint 100 can serve as a visual indicator that sleeves 300 are properly installed on joint 200 and that the connection is properly assembled. In addition, once the splice restraint 100 is positioned and/or tightened onto groove 302 of sleeves 300, splice restraint 100 can help secure the entire connection and help maintain sleeves 300 onto joint 200.

Figure 15:
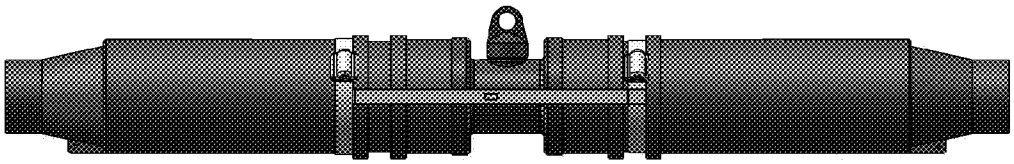
FIG. 15 is a side view of an alternate embodiment of the splice restraint system of FIG. 1, installed on an I joint with a sleeve on each leg of the I joint.
Figure 16:
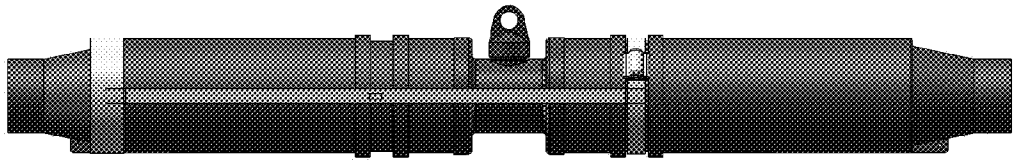
FIG. 16 is a side view of an alternate embodiment of the splice restraint system of FIG. 1, installed on an I joint with a sleeve on each leg of the I joint.
Figure 17:
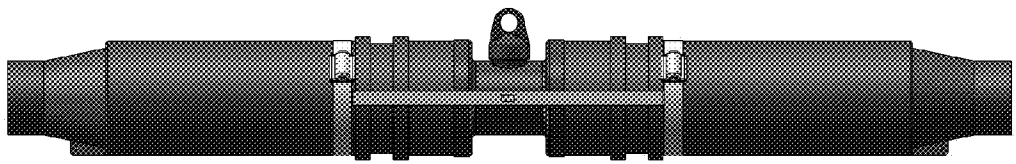
FIG. 17 is a side view of an alternate embodiment of the splice restraint system of FIG. 1, installed on an I joint with a sleeve on each leg of the I joint.
Figure 18:
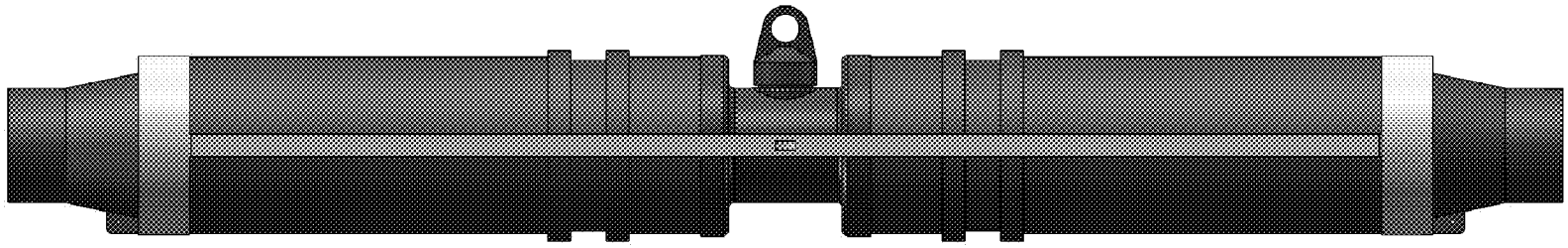
FIG. 18 is a side view of an alternate embodiment of the splice restraint system of FIG. 1, installed on an I joint with a sleeve on each leg of the I joint.
Figure 19:
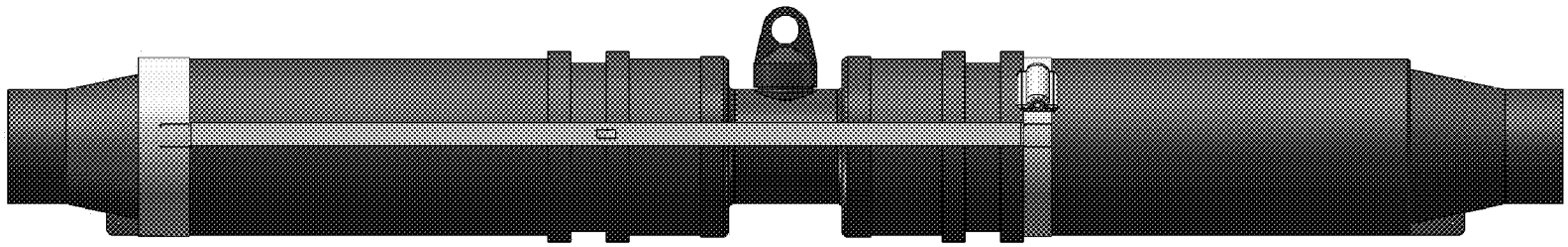
FIG. 19 is a side view of an alternate embodiment of the splice restraint system of FIG. 1, installed on an I joint with a sleeve on each leg of the I joint.
Figure 20:
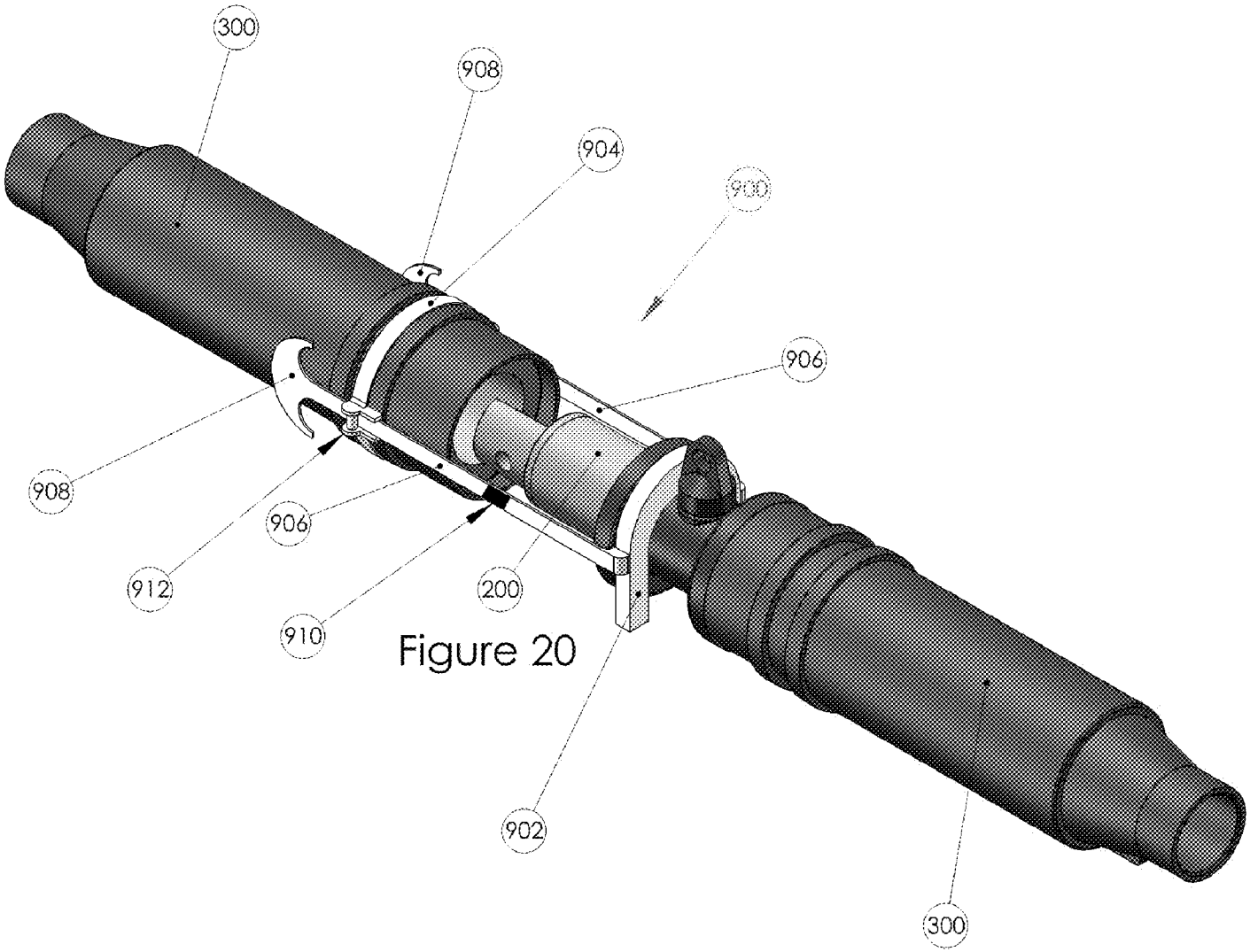
FIG. 20 is a perspective view of a splice restraint system in accordance with an embodiment of the invention, shown with one sleeve installed on an I joint, and a second sleeve not yet fully installed on the I joint.
Figure 21:
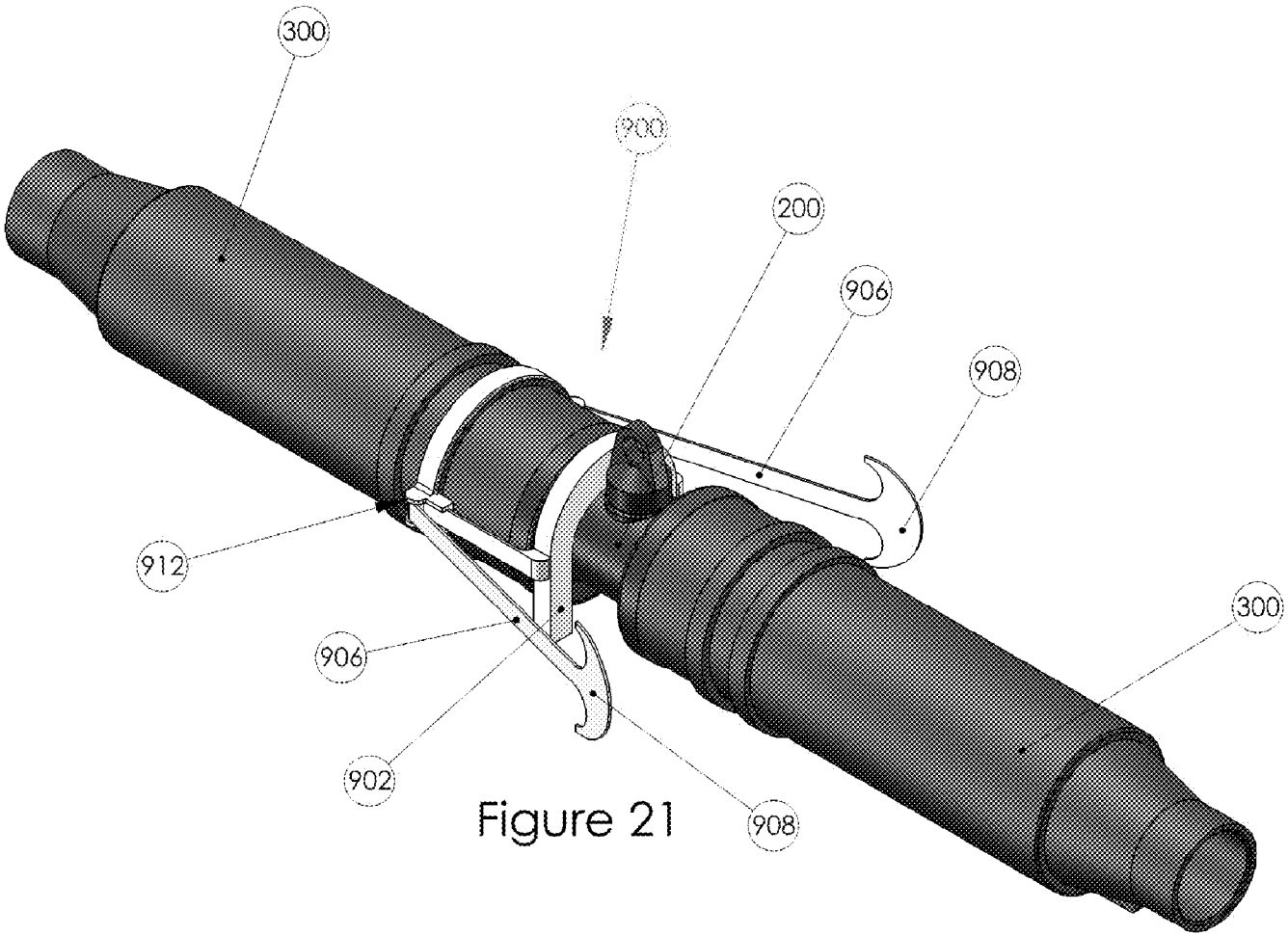
FIG. 21 is a perspective view of the splice restraint system of FIG. 20 with the second sleeve fully installed on the I joint.

It is to be understood that alternate embodiments of securing members 140 and strap(s) 110 are contemplated without deviating from the scope of the invention. For example, as seen in FIGS. 15-19, the mating point on the sleeve may be, by way of example, within groove 302 as described above, but could also be on one side of the groove (e.g., 306) as shown in FIGS. 15 and 17, at an end of the sleeve 308 proximate the cable entrance as shown in FIG. 16, or any other point on the sleeve to which the securing member can be securely fastened. In addition, the mating point on a first sleeve may be different than the mating point on a second sleeve. For example, as seen in FIGS. 15-19, the securing member may engage a first sleeve installed on a joint at groove 302, but may engage a second sleeve installed on the joint at point 308, by way of example. In other words, the securing members need not engage any two sleeves installed on a joint at the same position. In any event, the length of strap(s) 110 would be adjusted accordingly based on the specific mating point(s) chosen.

In addition, while in a preferred embodiment the securing members 140 and strap(s) 110 are formed of a suitable metal, one or more of the elements of the splice restraint may be formed of different materials. In addition, securing member 140 can be constructed to maintain its shape after being positioned, preferably constructed to withstand a tugging force, be tied or otherwise secured in position, etc., and securing members 140 can be constructed similar to a conventional hose clamp, wherein one end is notched and is designed to be fed into a corresponding screw mechanism 130 for tightening securing member 140. However, it is to be understood that other suitable strap and/or clamp assembly can be used without deviating from the scope of the invention. In addition, while the embodiment depicted in FIG. 1 shows two straps 110, any number of straps could be used without departing from the spirit of the invention.

In use, by way of example, securing member 140 can be positioned within groove 302 of sleeves 300. One or more loose ends of securing member 140 can be placed within and/or wrapped around sleeve 300 within groove 302 and secured in place, for example, by a clamp 130. Clamp 130 is preferably a worm gear-type tightening device. The diameter of securing member 140 after it is tightened is preferably less than the outer diameter of raised member 314 of sleeve 300, such that raised member 314 prevents securing member 140 from sliding off sleeve 300.

Splice restraint 100 can include two securing members 140, each received in the corresponding groove of a corresponding sleeve positioned on opposite ends of the joint as shown, by way of example, in FIG. 3. In the embodiment shown, the displacement of sleeve 300 away from the connection with joint 200 can be prevented by splice restraint 100. Accordingly, splice restraint 100 can prevent the inadvertent loosening of the connection while also providing a visual indication that sleeves 300 are properly installed on joint 200. Thus, the embodiment of splice restraint 100 described herein can provide a visual indication that sleeves are properly installed, as well as ensure that sleeves will not be displaced after the lineman leaves the site.

Figure 4:
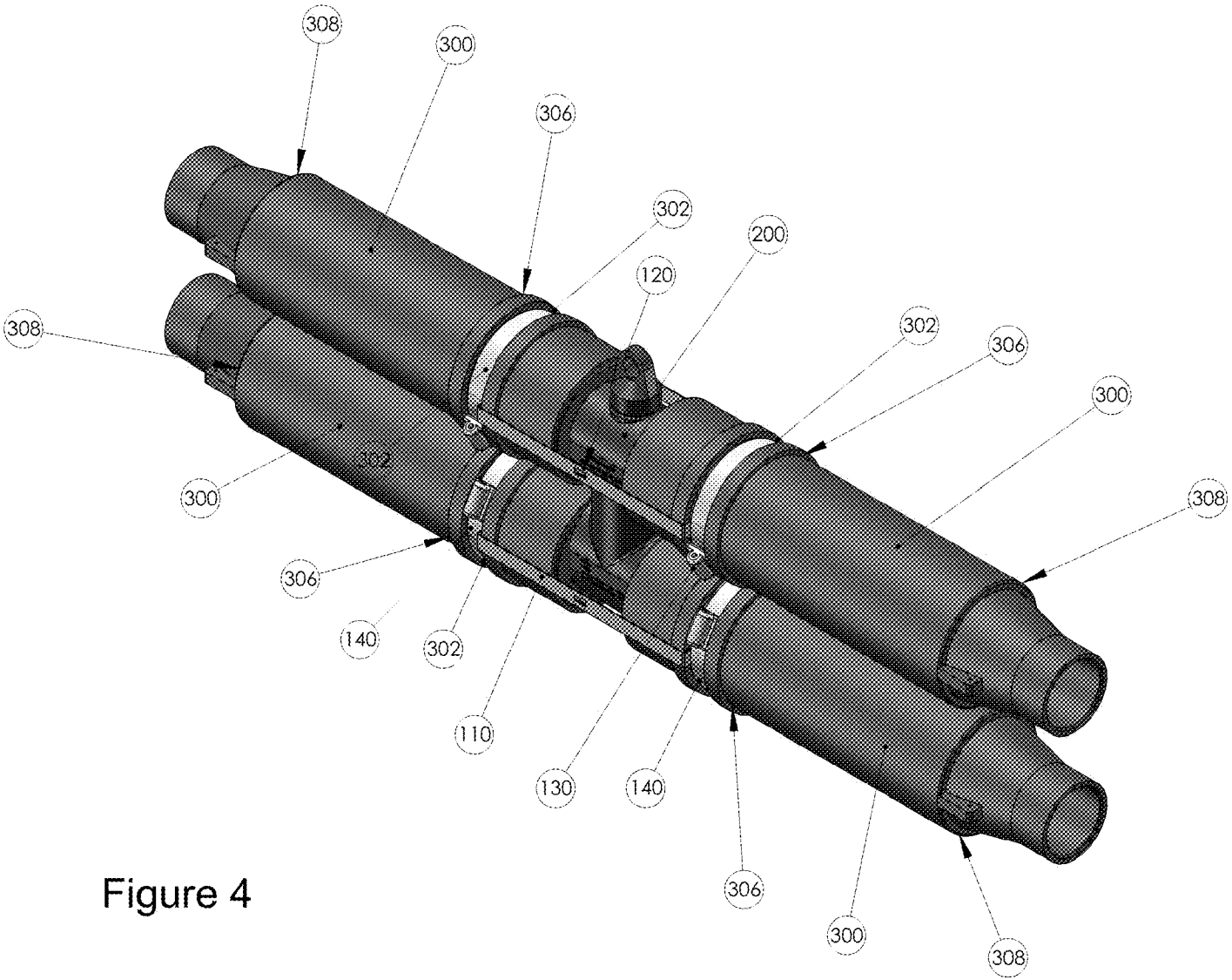
FIG. 4 is a perspective view of a splice restraint system of FIG. 1 installed on an H joint with a sleeve on each of the four legs of the H joint.

While the embodiment of splice restraint 100 is illustrated with respect to an I-joint, it is to be understood that splice restraint 100 can be used, with or without modifications as necessary, with respect to other joints, such as Y-joints, H-joints, etc. For example, a system with an H-joint can include two splice restraints 100 as seen in FIG. 4, or a modification including two splice restraints 100 connected to each other by one or more additional connecting members (not shown). A system with a Y-joint can include a splice restraint 100 as described herein and as seen in FIG. 10.

Figure 5:
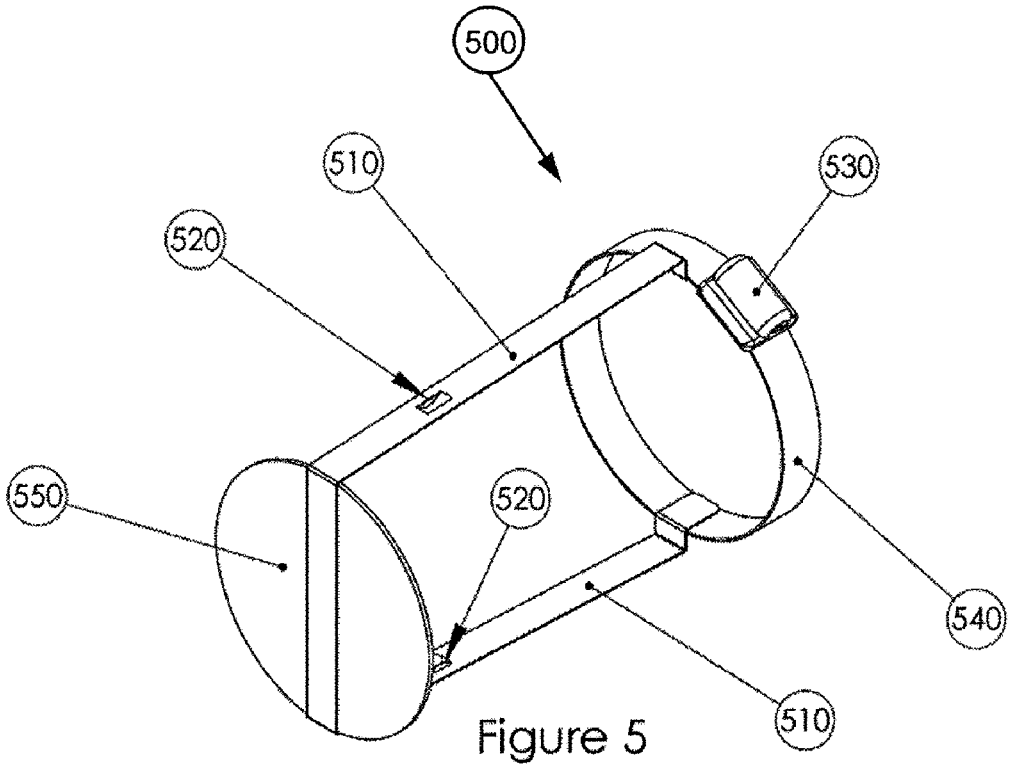
FIG. 5 is a perspective view of a splice restraint system in accordance with an embodiment of the invention.
Figure 6:
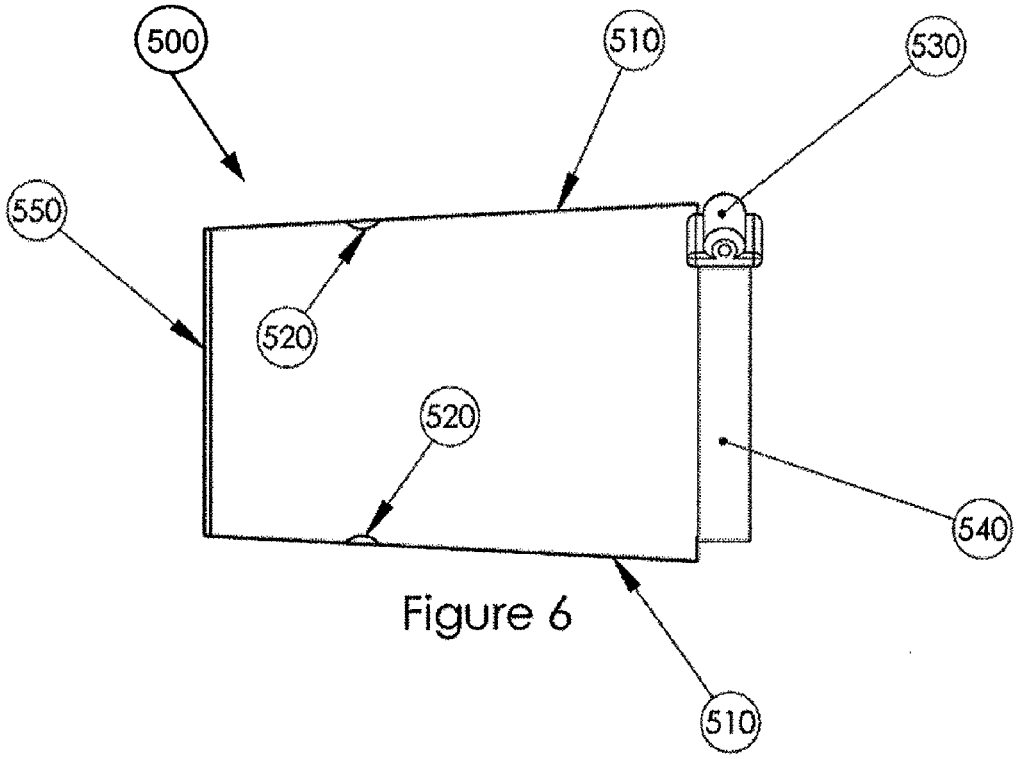
FIG. 6 is side view of the splice restraint system of FIG. 5.
Figure 7:
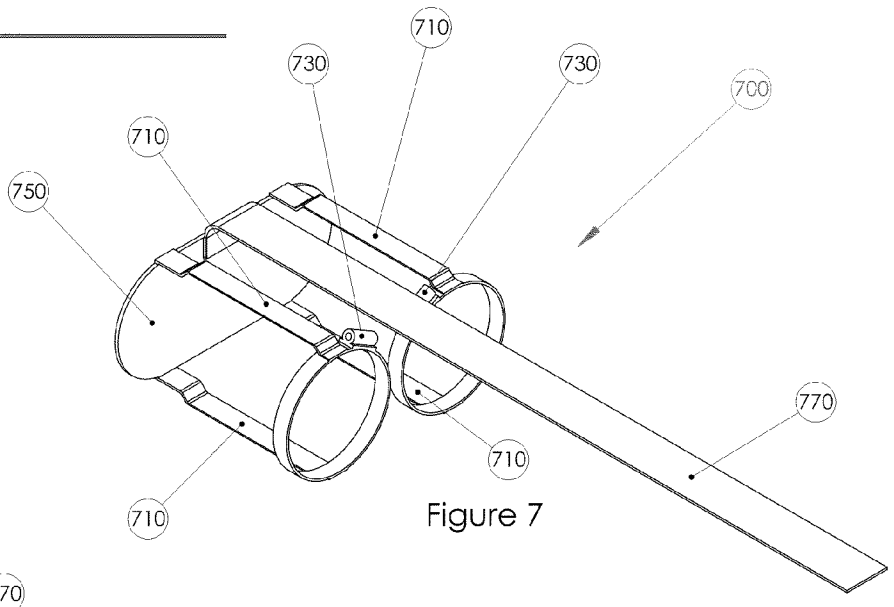
FIG. 7 is a perspective view of a splice restraint system in accordance with an embodiment of the invention.
Figure 8:
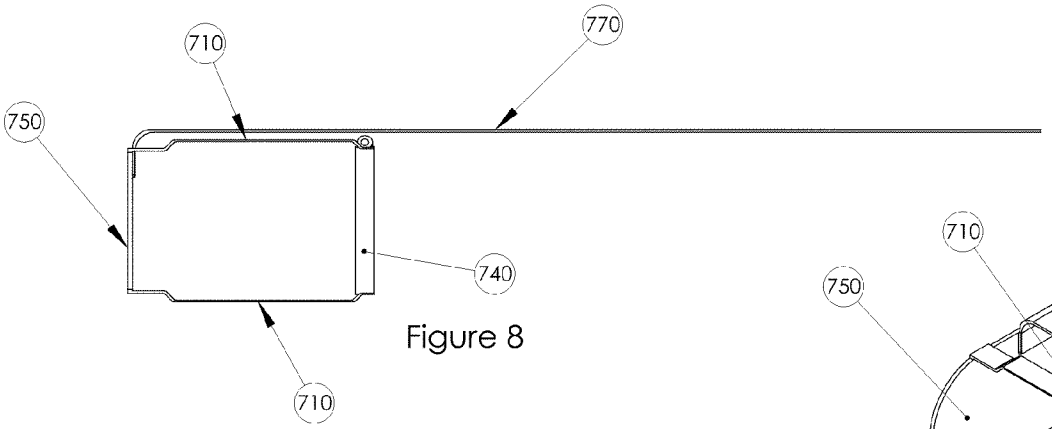
FIG. 8 is a side view of the splice restraint system of FIG. 7.
Figure 9:
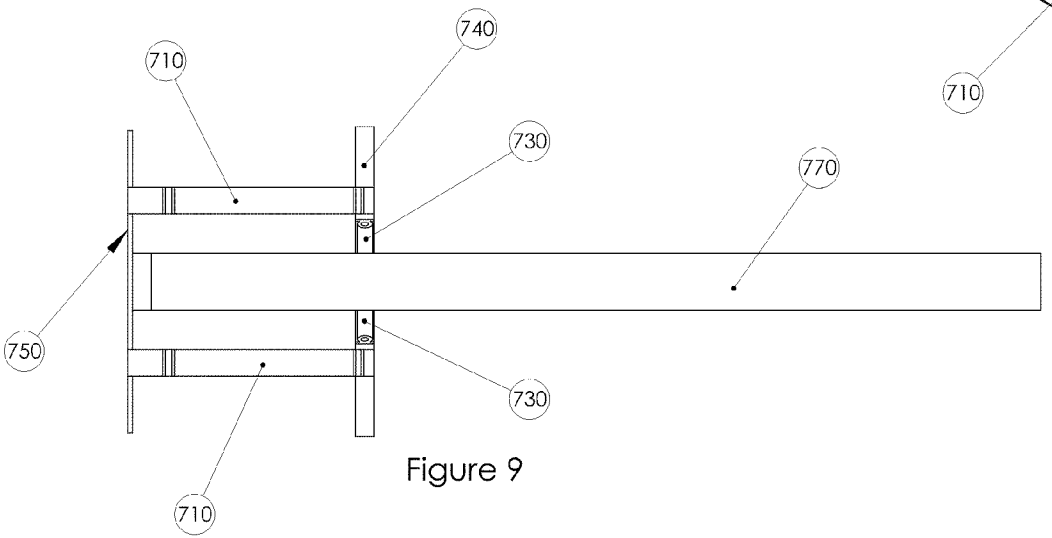
FIG. 9 is a top view of the splice restraint system of FIG. 7.
Figures 10, 10A:
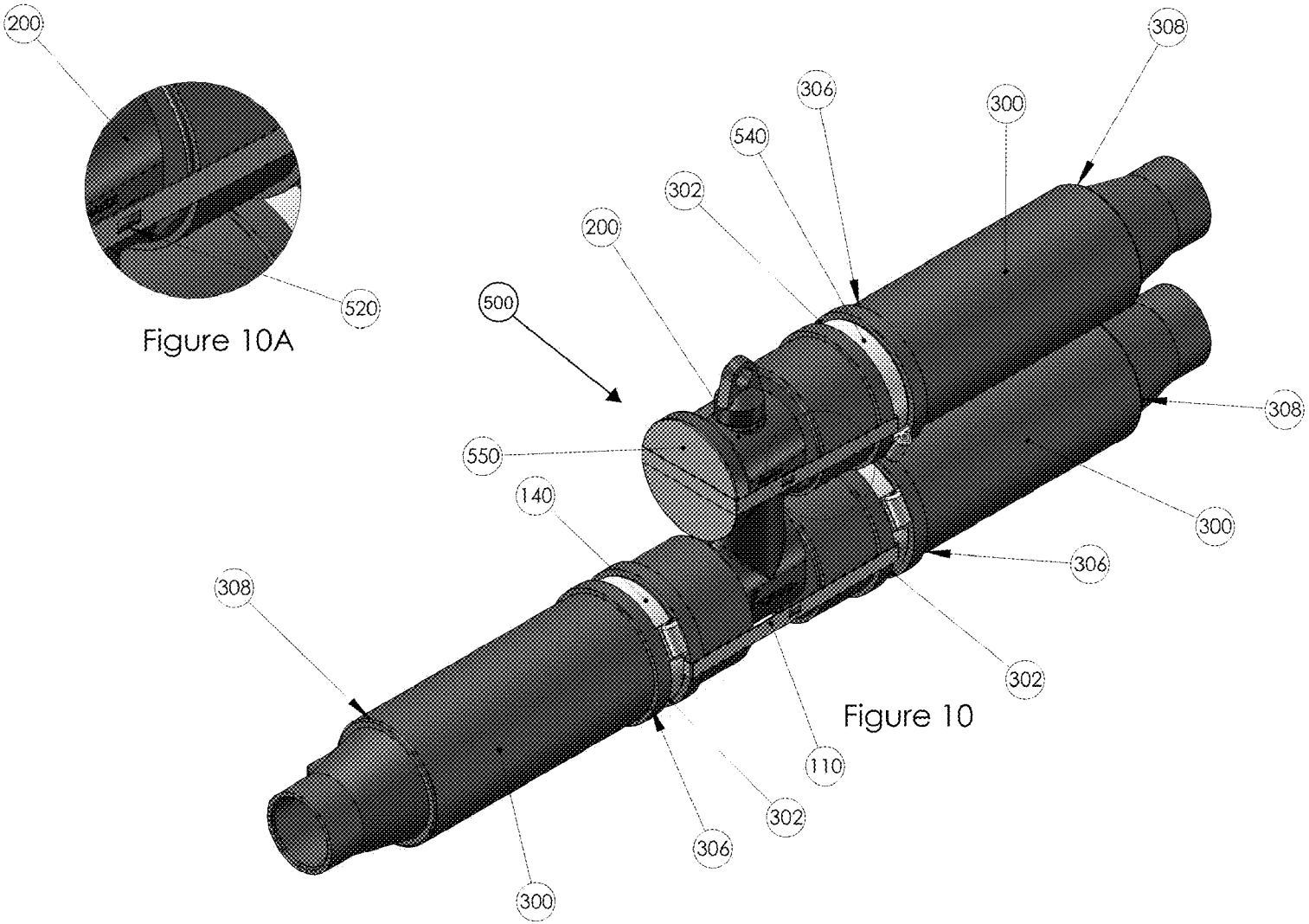
FIG. 10 is a perspective view of the splice restraint system of FIG. 1 and the splice restraint system of FIG. 5 installed on a Y joint with a sleeve on each of the three legs of the Y joint.
FIG. 10A is an enlarged view of the grounding eye of the splice restraint system of FIG. 5 shown in FIG. 10.
Figure 13:
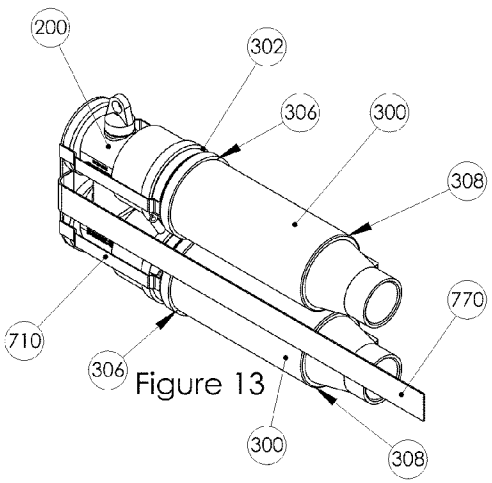
FIG. 13 is a perspective view of the splice restraint system of FIG. 11.
Figure 14:
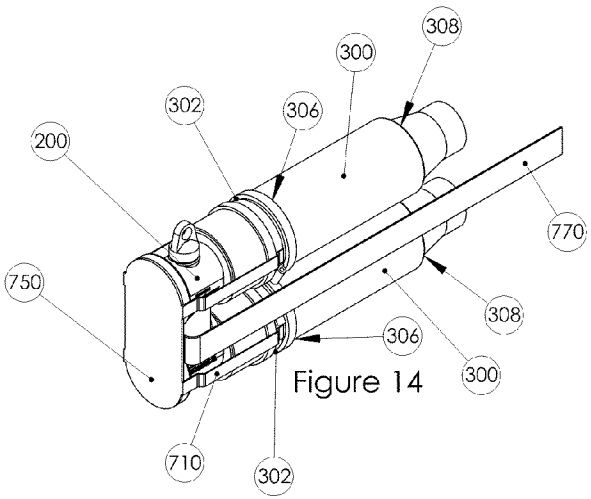
FIG. 14 is another perspective view of the splice restraint system of FIG. 11.
Figure 11:
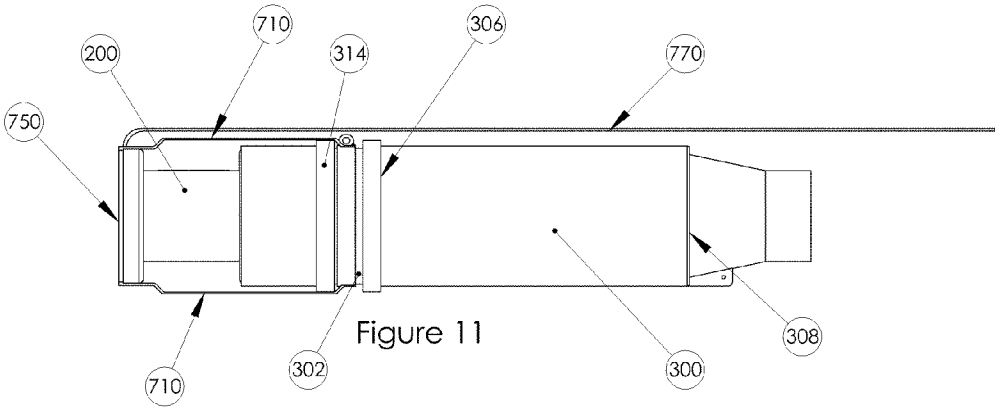
FIG. 11 is a side view of the splice restraint system of FIG. 7 installed on a U joint having a sleeve on each of the two legs of the U joint.
Figure 12:
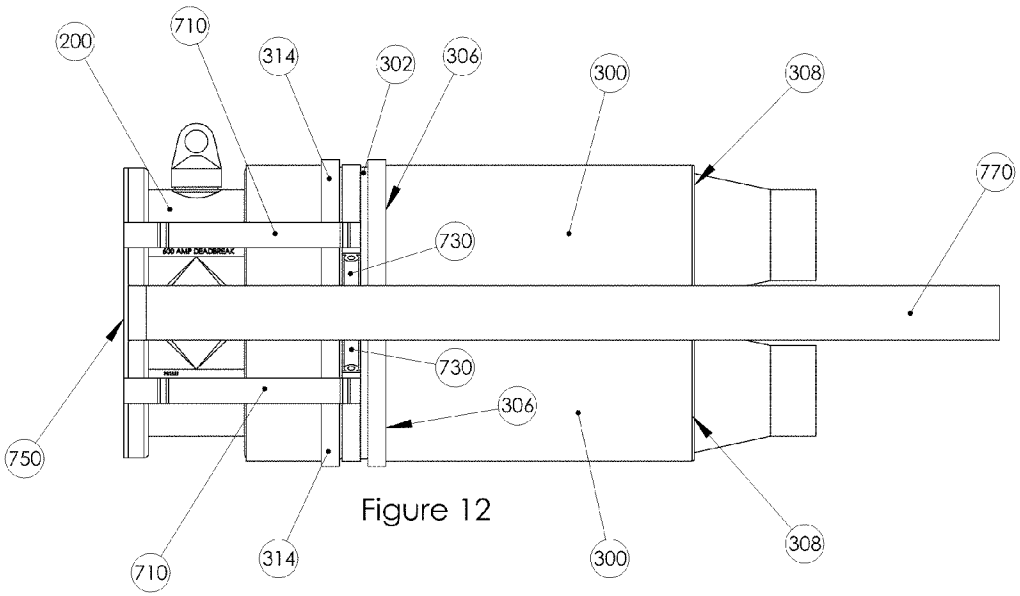
FIG. 12 is a top view of the splice restraint system of FIG. 11.

An embodiment of splice restraint 500 for use with a Y or U joint is depicted in FIGS. 5, 6 and 10. As shown, splice restraint 500 can include one or more straps 510, which may include a grounding eye 520. At one end of the splice restraint 500 is a securing member 540 which can include a tightening device 530. The strap(s) 510, securing member 540, grounding eye 520 and tightening device 530 are each constructed and arranged in accordance with and/or in a similar manner as described with respect to splice restraint 100.

At the opposite end of splice restraint 500 is a plate 550 that is attached to strap(s) 510. The plate 550 can be made of metal or any other suitable material, and can be a solid plate as depicted or any other design that achieves the structural strength of the plate 550 as contemplated herein. The splice restraint 500 is suitable for use, by way of example, on a Y joint as seen in FIG. 10. In use, the securing member 540 can be applied to groove 302 of sleeve 300 as described earlier with respect to splice restraint 100, and the plate 550 is positioned over the open end of the Y joint. Securing member 540 may also engage sleeve 300 at point 306, 308, or at any other suitable point along sleeve 300 as a matter of design choice.

Strap(s) 510 are of a length that is determined by the distance between the mating point on the sleeve (for example, groove 302) and the end of the joint when sleeve 300 is properly positioned on the joint, as seen by way of example in FIG. 10 with respect to a Y joint. In the embodiment shown in FIG. 10, splice restraint 100 is used in connection with the two other legs of the Y joint. Splice restraint 500 described herein can provide a visual indication that sleeve 300 is properly installed on the joint, as well ensure that sleeve will not be displaced after the lineman leaves the site. The length of strap(s) 510 would be adjusted accordingly if a different mating point were chosen on sleeve 300.

An embodiment of a splice restraint 700 for use with a U joint is depicted in FIGS. 7-9 and 11-14. At one end of the splice restraint 700 are two securing members 740 each of which can include a tightening device 730. At the opposite end of splice restraint 700 is a plate 750. Plate 750 is attached to the two securing members 740 via one or more straps 710. The strap(s) 710, securing member 740, tightening device 730, and plate 750 are each constructed and arranged in accordance with and/or in a similar manner as described earlier with respect to splice restraints 100 and 500. Splice restraint 700 also includes a grounding braid 770 that can be connected to the plate 750. Grounding braid is formed of a suitable conducting material.

Splice restraint 700 is suitable for use, by way of example, on a U joint as seen in FIGS. 11-14. In use, the securing members 740 can be applied to groove 302 of sleeve 300 as described earlier, and the plate 750 is positioned over the other end of the joint. Securing member can also be applied at points 306, 308 or at any other suitable place along sleeve 300 as a matter of design choice. Straps 710 are of a length that is determined by the distance between the mating point on the sleeve (for example groove 302) and the end of the joint when sleeve 300 is properly positioned on the joint, as seen by way of example in FIGS. 13 and 14 with respect to a U joint. The length of straps 710 can be adjusted if different mating points are chosen, as described above. Grounding braid 770 is electrically connected to a suitable member in a manner known in the art. Splice restraint 700 described herein can provide a visual indication that sleeve 300 is properly installed on the joint, as well ensure that sleeve will not be displaced after the lineman leaves the site.

The splice restraint(s) of the present invention can also be incorporated into a tool for positioning the sleeves onto the joint. For example, as seen in FIGS. 20-25, the splice restraint system 900 can include a first securing member 902 constructed and arranged to engage the joint 200, a second securing member 904 constructed and arranged engage a sleeve 300 installable on the joint, and one or more flexible straps 906 connected to the first securing member 902 and movably engaging the second securing member 904. The strap(s) 906 can include a handle member 908.

Figure 24:
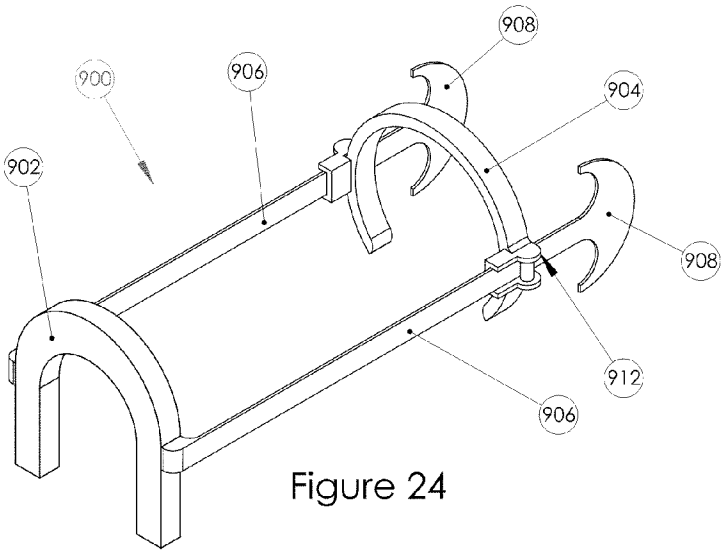
FIG. 24 is a perspective view of the splice restraint system of FIG. 20.
Figure 25:
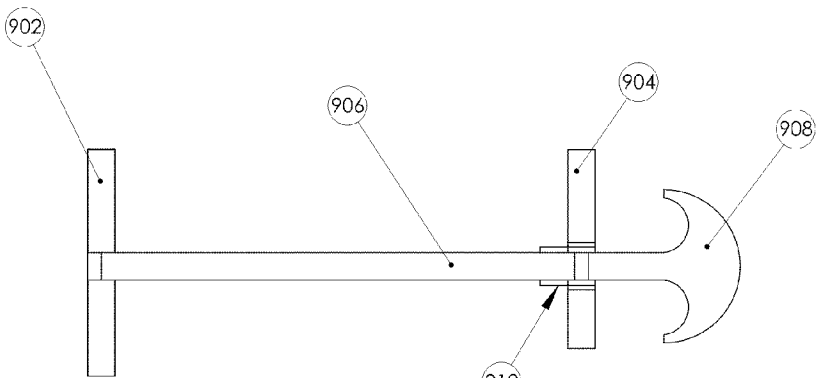
FIG. 25 is a side view of the splice restraint system of FIG. 20.
Figure 22:
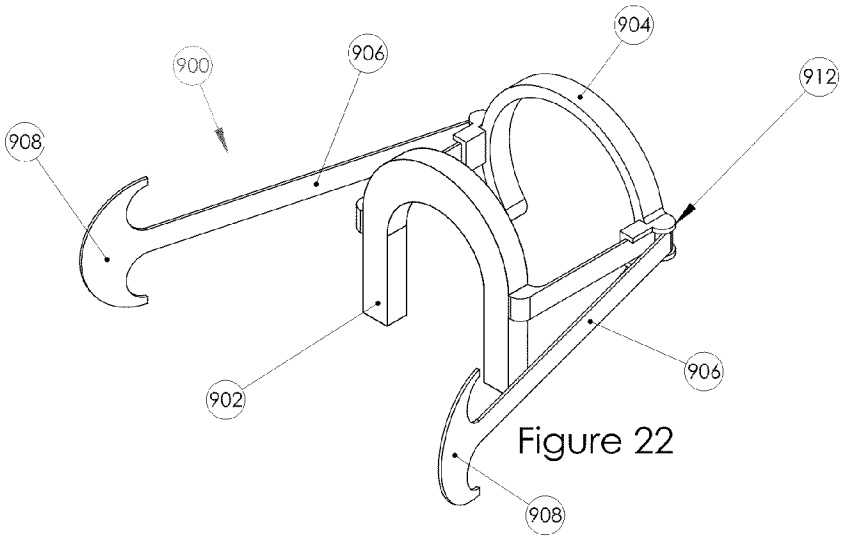
FIG. 22 is a perspective view of the splice restraint system of FIG. 21.
Figure 23:
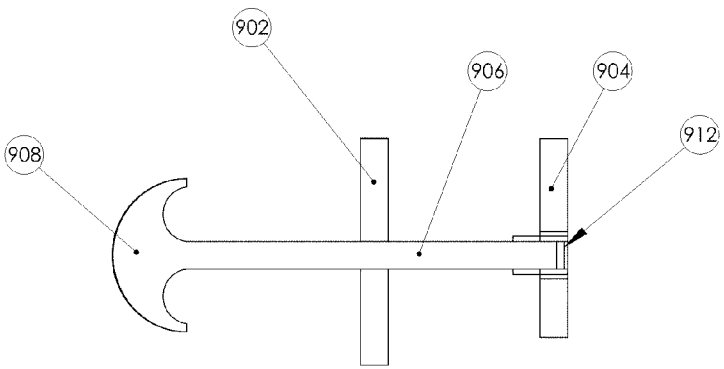
FIG. 23 is a side view of the splice restraint system of FIG. 21.

The first securing member 902 can be U-shaped (as seen in FIGS. 21-25) to permit easy installation of the splice restraint system over the joint 200. Other shapes are contemplated without departing from the invention. The second securing member 904 can be an open ring shape (as seen in FIGS. 22 and 24) that are resilient and flexible enough to engage sleeve 300 when sufficient pressure is applied. Second securing member 904 can also be a closed-ring design as described previously with respect to splice restraint 100, and other shapes and constructions are contemplated herein without departing from the spirit of the invention. Strap(s) 906 are preferably formed of a flexible material, such as plastic, and include a locking mechanism 910 that is designed and constructed to engage when the sleeve 300 is properly positioned in the joint 200. The excess length of the straps 906 can be removed (e.g., cut) once the sleeve is properly positioned on the joint.

In use, in order to properly position and secure the sleeve 300 to the joint 200, the lineman would position first securing member 902 to engage the joint 200, position the second securing member 904 to engage the sleeve 300, and then pull on handles 908 in a direction towards joint 200. The straps 906 would slide and/or pivot through or around a pin member 912 thereby moving sleeve 300 towards joint 200. The straps 906 can include a locking mechanism 910 that engages second securing member 904 and/or pin member 912 when sleeve 300 is properly positioned on joint 200. In preferred embodiment, straps 906, or a portion thereof, are formed of a plastic or other suitable flexible material, and the locking mechanism is a zip-tie like mechanism that can securely maintain straps 906 to second securing member 904 at the appropriate position when sleeve 300 is properly installed on joint 200. The straps can also include visual markings to indicate when sleeve 300 is properly positioned on joint 200. In addition, while the second securing member is shown as engaging sleeve 300 at groove 302, other mating points are contemplated as described earlier with respect to splice restraints 100, 500 and 700. In addition, while the first securing member is shown as engaging joint 200, other mating points are contemplated herein.

The embodiments of splice restraint 100, 500, 700 and 900 preferably facilitate securing and visually indicating proper installation of sleeves with respect to a joint without requiring specially made sleeves or joints. For example, sleeves 300 are generally provided with raised members 314/316 forming grooves 302 molded therein to facilitate positioning of the sleeve onto the joint, and are also provided with end point 308 molded therein. Therefore, splice restraint 100, 500, 700 and 900 can be used with existing sleeves and joints.

Preferably, splice restraint 100, 500, 700 and 900, and the component parts thereof, are made of a resilient material, such as steel, plastic or kevlar, or any combination of the same, which preferably does not stretch and can withstand a pulling or pushing force, impact, and other forces that splice restraint 100, 500, 700 and 900 may encounter.

The examples provided are merely exemplary, as a matter of application specific to design choice, and should not be construed to limit the scope of the invention in any way. Thus, while there have been shown and described and pointed out novel features of the present invention as applied to preferred embodiments thereof, it will be understood that various omissions and substitutions and changes in the form and details of the disclosed invention may be made by those skilled in the art without departing from the spirit of the invention. For example, the material, size, and design of the splice restraint, the number of straps, securing members, etc., can be varied without deviating from the scope of the invention. It is the intention, therefore, to be limited only as indicated by the scope of the claims appended hereto.

It is also to be understood that the following claims are intended to cover all of the generic and specific features of the invention herein described and all statements of the scope of the invention which, as a matter of language, might be said to fall therebetween.

What is claimed is:

1. A splice restraint for use with sleeves that attach to electrical joints in an electrical power distribution system, the splice restraint comprising:

a first securing member configured to engage a first sleeve installable on a first leg of a joint at a first point, the first securing member extending around the entire circumference of the first groove and further comprising a tightening device for tightening the first securing member to the first sleeve;

a second securing member configured to engage a second sleeve installable on a second leg of said joint at a second point; and a strap connecting the first securing member to the second securing member, the strap having a length determined by the distance between the first point on the first sleeve and the second point on the second sleeve when the first and second sleeves are properly installed on the joint;

wherein the first point is within a groove formed in the first sleeve, and the second point is within a groove formed in the second sleeve.

2. The splice restraint of claim 1 further comprising a second strap connecting the first securing member to the second securing member, the second strap having a length determined by the distance between the first point on the first sleeve and the second point on the second sleeve when the first and second sleeves are properly installed on the joint.

3. The splice restraint of claim 1, wherein the strap comprises a grounding eye.

4. The splice restraint of claim 1, wherein the tightening device comprises a worm gear.

5. The splice restraint of claim 1, wherein the second securing member extends around the entire circumference of the second groove and further comprises a tightening device comprising a worm gear for tightening the second securing member to the second sleeve.

6. The splice restraint of claim 1, wherein the strap connects to an inner side of the first securing member such that the strap is sandwiched between the first securing member and the first sleeve when the first securing member engages with the first sleeve.

7. The splice restraint of claim 1, wherein the second securing member is configured to be flexible enough to expand around and into at least a portion of the groove when sufficient pressure is applied and resilient enough to hold the first and second sleeves onto the joint without a tightening device.

8. The splice restraint of claim 1, wherein the first point is proximate a raised member formed in the first sleeve.

9. The splice restraint of claim 1, wherein the second point is proximate a raised member formed in the second sleeve.

10. The splice restraint of claim 1, wherein the first point is an end of the first sleeve distal a cable end of the sleeve.

11. The splice restraint of claim 1, wherein the second point is at an end of the second sleeve distal a cable end of the sleeve.

* * * * *